US008929771B2

(12) United States Patent
Hashimoto

(10) Patent No.: US 8,929,771 B2
(45) Date of Patent: Jan. 6, 2015

(54) IMAGE FORMING DEVICE

(75) Inventor: Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 183 days.

(21) Appl. No.: 13/432,043

(22) Filed: Mar. 28, 2012

(65) Prior Publication Data

US 2012/0251170 A1 Oct. 4, 2012

(30) Foreign Application Priority Data

Mar. 31, 2011 (JP) ..... 2011-078450

(51) Int. Cl.
*G03G 15/01* (2006.01)
*G03G 21/16* (2006.01)

(52) U.S. Cl.
CPC ..... *G03G 15/0189* (2013.01); *G03G 21/1647* (2013.01); *G03G 21/1676* (2013.01)
USPC ..... 399/111; 399/116

(58) Field of Classification Search
CPC ..... G03G 21/1857
USPC ..... 399/126, 234, 228, 111, 116
See application file for complete search history.

(56) References Cited

U.S. PATENT DOCUMENTS

| | | | | |
|---|---|---|---|---|
| 7,108,368 | B2 * | 9/2006 | Saito et al. | 347/104 |
| 7,526,232 | B2 | 4/2009 | Kamimura et al. | |
| 7,680,436 | B2 | 3/2010 | Hayakawa | |
| 7,706,723 | B2 | 4/2010 | Ishida et al. | |
| 7,826,773 | B2 * | 11/2010 | Kawamura | 399/228 |
| 8,190,059 | B2 | 5/2012 | Hayakawa | |
| 2003/0138275 | A1 | 7/2003 | Yabuki et al. | |
| 2007/0053719 | A1 | 3/2007 | Kamimura et al. | |
| 2007/0147890 | A1 | 6/2007 | Hayakawa | |
| 2007/0177899 | A1 | 8/2007 | Kawamura | |
| 2008/0089713 | A1 | 4/2008 | Ishida et al. | |
| 2009/0169247 | A1 * | 7/2009 | Hattori | 399/111 |
| 2009/0252530 | A1 | 10/2009 | Nakashima | |
| 2011/0091237 | A1 * | 4/2011 | Suzuki | 399/101 |
| 2011/0200359 | A1 | 8/2011 | Hayakawa | |

FOREIGN PATENT DOCUMENTS

| | | |
|---|---|---|
| CN | 1991624 A | 7/2007 |
| JP | 2001-117314 | 4/2001 |
| JP | 2003-149910 A | 5/2003 |
| JP | 2006-349763 A | 12/2006 |

(Continued)

OTHER PUBLICATIONS

Co-pending U.S. Appl. No. 13/432,061, filed Mar. 28, 2012.

(Continued)

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

An image forming device includes a motor capable of positive rotation and reverse rotation, a photoconductor drum, a developing roller, a contact/separation cam and a switching cam. The contact/separation cam is configured to move the developing roller. The switching cam is configured to switch a position of a transmission member. An electromagnetic clutch is disposed between one of the contact/separation cam and the switching cam and the motor. The other cam is connected to the motor without the electromagnetic clutch. The contact/separation cam and the switching cam are driven by using the positive rotation and the reverse rotation of the motor and the electromagnetic clutch.

14 Claims, 11 Drawing Sheets

(56) References Cited

FOREIGN PATENT DOCUMENTS

| | | | |
|---|---|---|---|
| JP | 2007-072021 | | 3/2007 |
| JP | 2007-094092 | A | 4/2007 |
| JP | 2007-178482 | A | 7/2007 |
| JP | 2008-116902 | A | 5/2008 |
| JP | 2009-036919 | A | 2/2009 |
| JP | 2009-162903 | | 7/2009 |
| JP | 2009-288358 | | 12/2009 |
| JP | 2010-262062 | | 11/2010 |

OTHER PUBLICATIONS

Co-pending U.S. Appl. No. 13/432,073, filed Mar. 28, 2012.
Notice of Reasons for Rejection issued in related Japanese Patent Application No. 2011-078987 mailed Mar. 19, 2013.
Non-final Office Action issued in U.S. Appl. No. 13/432,061 mailed Dec. 24, 2013.
Office Action issued in Chinese Patent Application No. 201210089423.6 mailed May 5, 2014.
First Office Action issued in corresponding Chinese Patent Application No. 201210090346.6 mailed May 6, 2014.

* cited by examiner

FRONT ⟷ REAR

IMAGE FORMING DEVICE

CROSS REFERENCE TO RELATED APPLICATION

The present application claims priority from Japanese Patent Application No. 2011-078450, which was filed on Mar. 31, 2011, the disclosure of which is incorporated herein by reference in its entirety.

BACKGROUND

1. Technical Field

The present invention relates to an image forming device including a contact/separation cam that allows a developing roller to contact with and separate from a photoconductor drum, and a switching cam that switches on/off the transmission of a driving force to the developing roller.

2. Related Art

An image forming device including a contact/separation cam capable of moving a developing roller in a rectilinear direction to contact with and separate from a photoconductor drum and a stepping motor for driving the contact/separation cam is known.

In such an image forming device, the motor for driving the photoconductor drum and the motor for driving the developing roller are separately provided, and there is a problem in that adding a motor increases the number of motors, increasing the cost.

SUMMARY

A need has arisen to provide an image forming device capable of reducing the number of motors and cutting costs.

An image forming device includes a motor, a photoconductor drum, a developing roller, a contact/separation cam and a switching cam. The motor is capable of positive rotation and reverse rotation. An electrostatic latent image is formed on the photoconductor drum. The developing roller is configured to contact the photoconductor drum and supply developer to the electrostatic latent image on the photoconductor drum. The contact/separation cam is configured to move the developing roller between a contact position contacting the photoconductor drum and a separate position separate from the photoconductor drum. The switching cam is configured to switch a position of a transmission member movable between a transmission position in which a driving force for the developing roller is transmitted to the developing roller and a breakoff position in which the driving force is broken off. An electromagnetic clutch is disposed between one of the contact/separation cam and the switching cam and the motor. The other cam is connected to the motor without the electromagnetic clutch. The contact/separation cam and the switching cam are driven by using the positive rotation and the reverse rotation of the motor and the electromagnetic clutch.

BRIEF DESCRIPTION OF THE DRAWINGS

FIG. 5A illustrates a color mode, FIG. 5B illustrates a monochrome mode, and FIG. 5C illustrates a complete separation mode.

FIG. 6A illustrates a color mode, FIG. 6B illustrates a monochrome mode, and FIG. 6C illustrates a complete separation mode.

DESCRIPTION OF THE PREFERRED EMBODIMENTS

An embodiment of the present invention will be described in detail with reference to the drawings. In the following description, first, the overall structure of a color printer (an example of an image forming apparatus) will be described, and then the details of the characterizing portion of the present invention will be described.

In the following description, terms such as front, rear, left, right, top, and bottom are used to refer to directions relative to a user using the color printer. That is to say, "front" means the right side of FIG. 1, "rear" means the left side of FIG. 1, "right" means the far side of the paper plane of FIG. 1, "left" means the near side of the paper plane of FIG. 1, and "top-bottom direction" means the top-bottom direction of FIG. 1.

Figure 1:
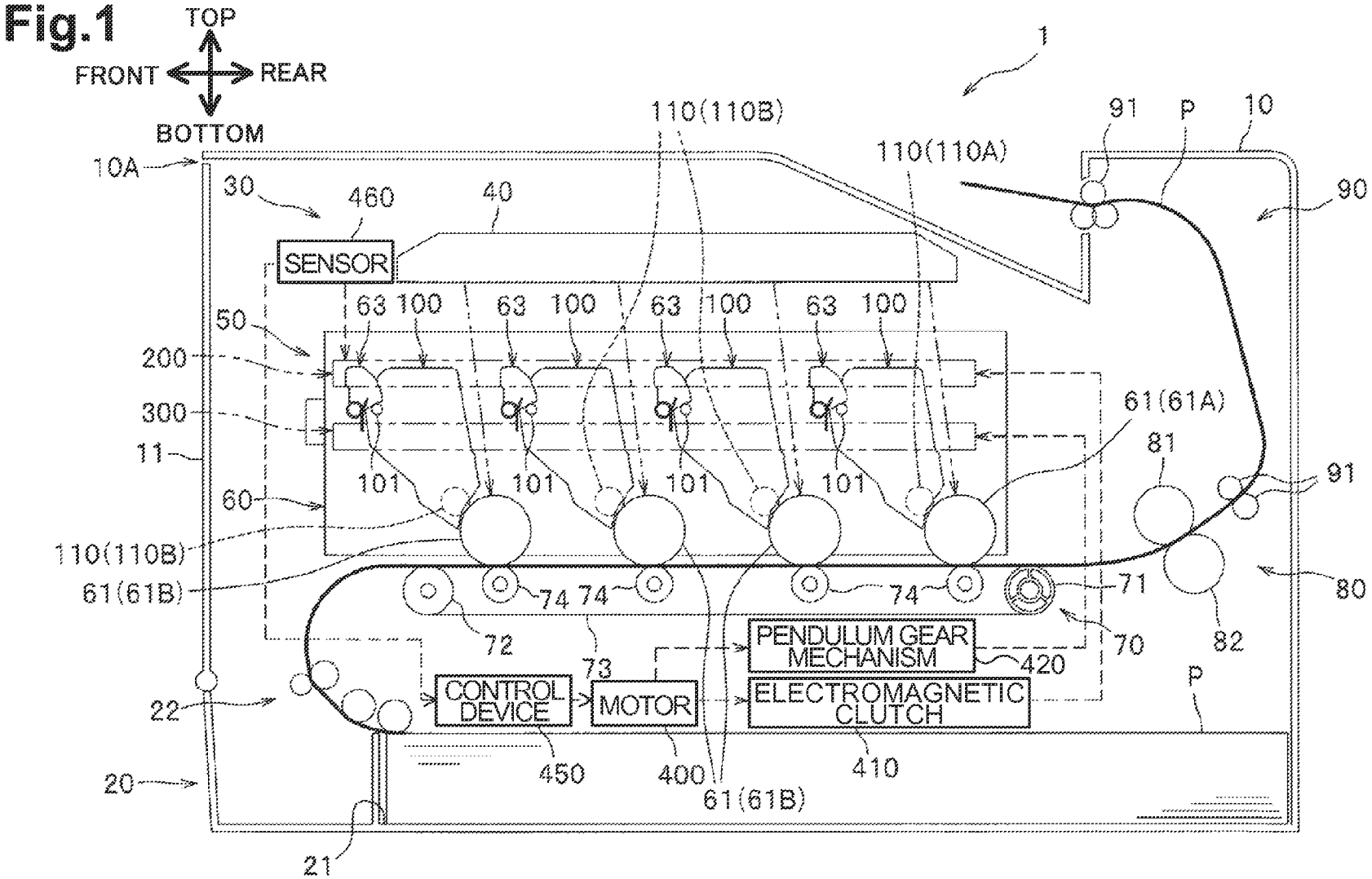
FIG. 1 is a schematic diagram illustrating a color printer according to an embodiment of the present invention.

As shown in FIG. 1, the color printer 1 has a paper feed portion 20 that feeds paper P into the apparatus main body 10, an image forming portion 30 that forms an image on paper P fed, and a paper discharging portion 90 that discharges paper P on which the image is formed.

The paper feed portion 20 has a paper feed tray 21 that houses paper P, and a paper conveying device 22 that conveys paper P from the paper feed tray 21 to the image forming portion 30.

The image forming portion 30 has a scanner unit 40, a process unit 50, a transfer unit 70, and a fixing device 80.

The scanner unit 40 is placed in the upper part of the inside of the apparatus main body 10, and has a laser emitter, a polygon mirror, lenses, and reflecting mirrors (not shown). The scanner unit 40 rapidly scans the surface of the photosensitive drum 61 (an example of a first member) of each process cartridge 50 with a laser beam through the path shown by a long dashed double-short dashed line in FIG. 1.

The processing unit 50 is detachable from and attachable to the device body 10 through an opening 10A that is formed by releasing a front cover disposed on a front surface of the device body 10. The processing unit 50 includes a drawer 60, and four developing cartridges 100 that are detachably provided in the drawer 60.

In addition to including four photoconductor drums 61, the drawer 60 includes known components, such as a charger, that are not illustrated in the drawings.

Each of the developing cartridges 100 is provided with a developing roller 110 (an example of a second member) that is rotatably in contact with the photoconductor drum 61 to provide a toner (an example of developer), and is appropriately provided with known components such as a toner holding chamber and a supply roller.

The transfer unit 70 is provided between the paper feed portion 20 and the process units 50, and has a driving roller 71, a driven roller 72, a conveying belt 73, and four transfer rollers 74.

The driving roller 71 and the driven roller 72 are disposed away from each other in the front-rear direction and parallel to each other, and the conveying belt 73 that is an endless belt is provided in a tensioned state therebetween. The outer surface of the conveying belt 73 is in contact with each photosensitive drum 61. On the inner side of the conveying belt 73, four transfer rollers 74 are disposed so as to face the photosensitive drums 61 with the conveying belt 73 therebetween. At the time of transfer, a transfer bias is applied to the transfer rollers 74 by constant current control.

The fixing device 80 is disposed at a rear side of the process units 50 and the transfer unit 70, and has a heating roller 81 and a pressure roller 82 that is disposed so as to face the heating roller 81 and presses the heating roller 81.

In the image forming portion 30 configured as above, first, the surface of each photosensitive drum 61 is uniformly charged by the charger and is then exposed by the scanner unit 40. This lowers the electrical potential of the exposed part, and an electrostatic latent image based on image data is formed on each photosensitive drum 61. After that, the developing roller 110 supplies toner in the developing cartridges 100 to the electrostatic latent image on the photosensitive drum 61, and a toner image is borne on the photosensitive drum 61.

Next, paper P fed onto the conveying belt 73 passes the nip between each photosensitive drum 61 and corresponding transfer roller 74, and the toner image formed on each photosensitive drum 61 is transferred onto the paper P. The paper P passes through the nip between the heating roller 81 and the pressure roller 82, and the toner image transferred onto the paper P is heat-fixed.

A paper discharging unit 90 includes a plurality of conveying rollers 91 that convey paper P. The paper P, on which a toner image is transferred and fixed by heat, is conveyed by the conveying rollers 91, and is discharged to the outside of the device body 10.

[Structures of Contact/Separation Cam 200 and Switching Cam 300]

Next, structures of a contact/separation cam 200 (an example of a first cam) and a switching cam 300 (an example of a second cam) are described in detail.

The contact/separation cam 200 is a translation cam capable of moving in the front-rear direction (in an array direction of a plurality of developing rollers 110), and is connected via an electromagnetic clutch 410 (an example of a first transmission mechanism) to a motor 400 (an example of a drive source) capable of reversible rotation provided in the device body 10. The contact/separation cam 200 is configured such that front-rear motion thereof causes the developing rollers 110 to move between a contact position that is in contact with the photoconductor drums 61 (the position illustrated in FIG. 2), and a separate position that is separate from the photoconductor drums 61 (the position illustrated in FIG. 3).

Figure 2:
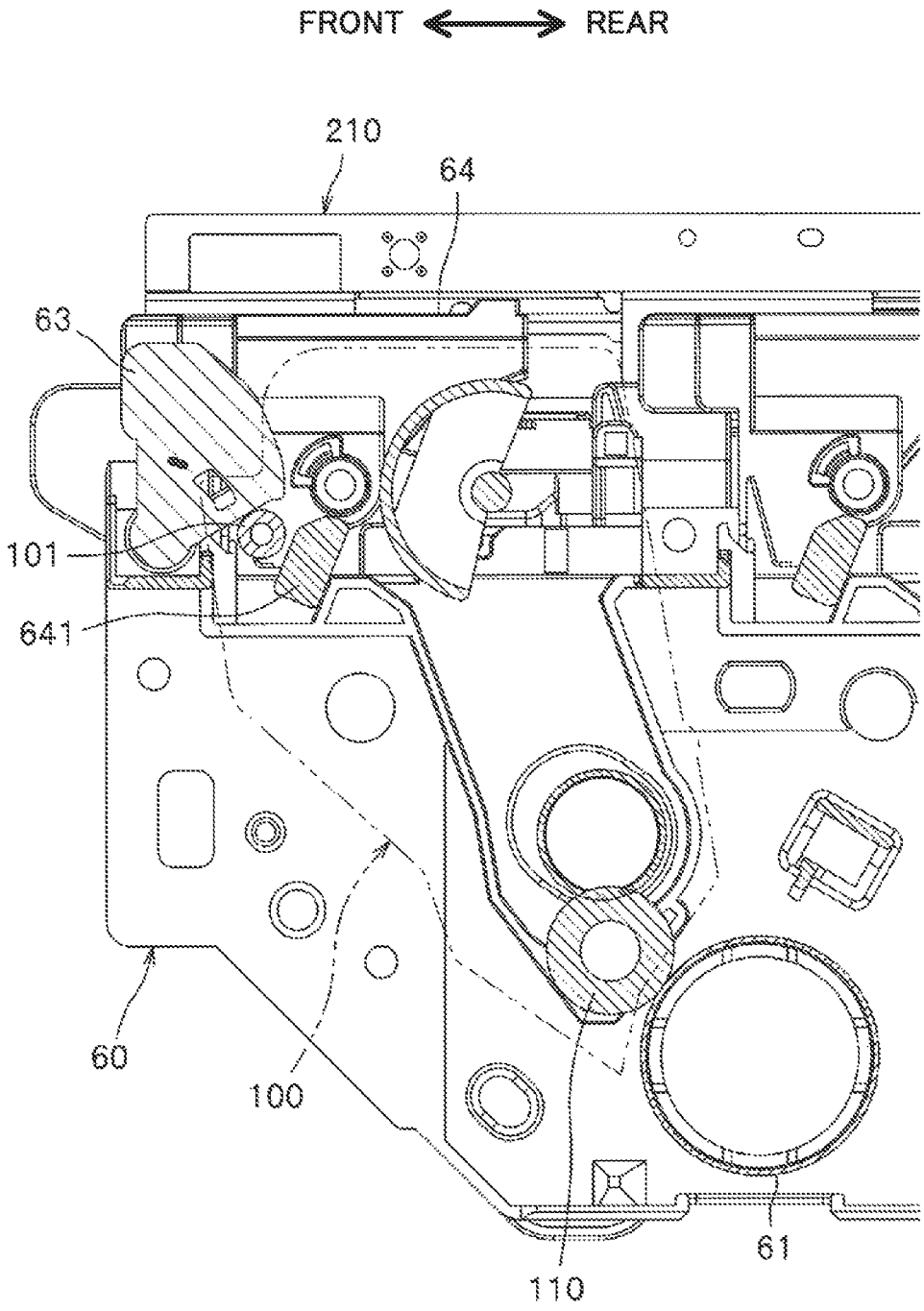
FIG. 2 is a sectional view illustrating a state in which a developing roller is positioned in a contact position.

Here, as illustrated in FIG. 2, the respective developing rollers 110 are formed so as to be urged, via the developing cartridges 100, toward the photoconductor drums 61 by using a plurality of press members 63 that are rotatably provided on the drawer 60. The press members 63 are urged in a clockwise direction in the drawings, by using a torsion spring, not illustrated in the drawings, thereby urging projections 101, formed on the developing cartridges 100, toward the photoconductor drums 61.

Figure 3:
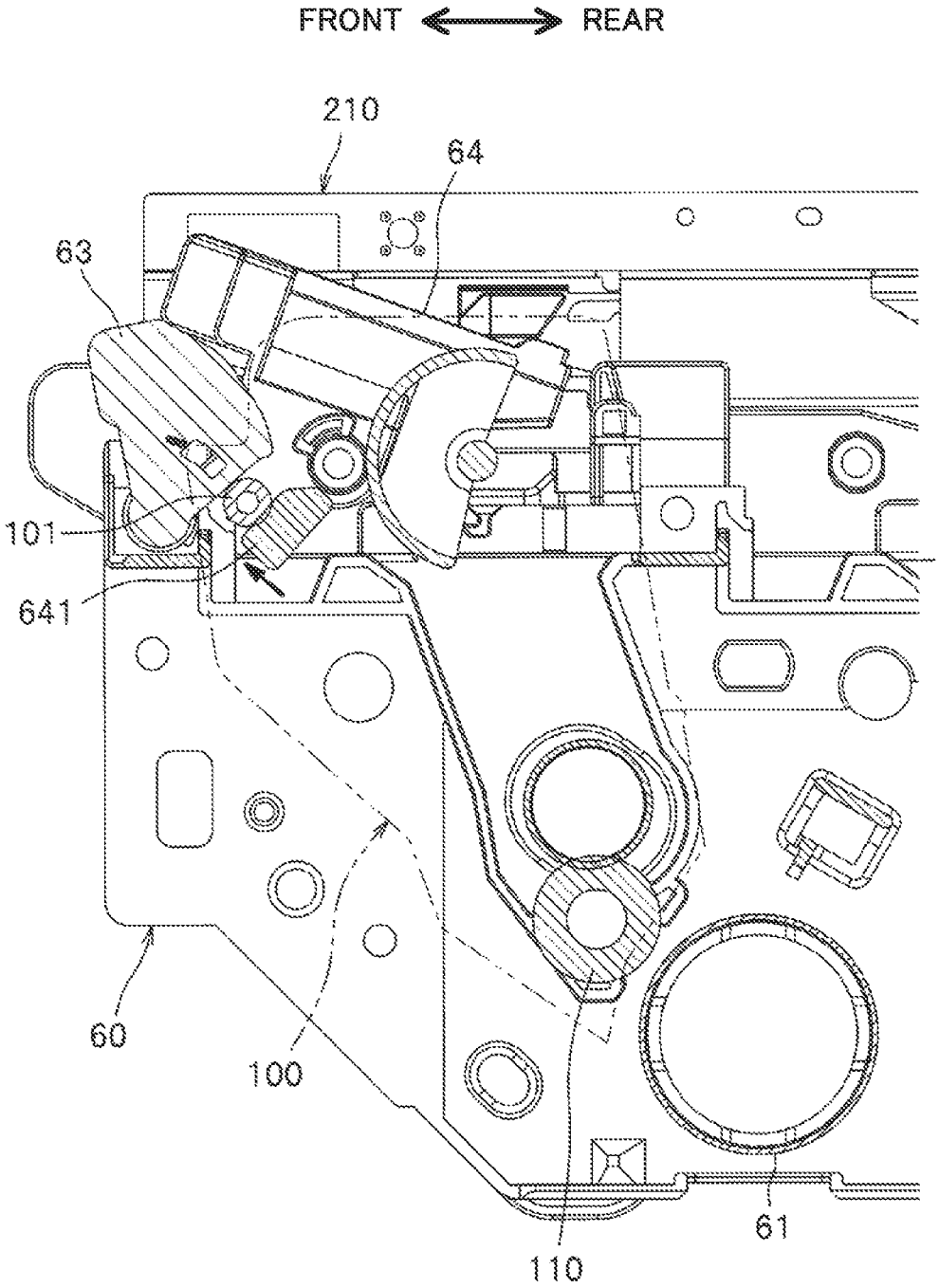
FIG. 3 is a sectional view illustrating a state in which a developing roller is positioned in a separate position.

Furthermore, the drawer 60 is provided with a plurality of separating levers 64, corresponding to the developing cartridges 100, that apply pressure to the projections 101 of the developing cartridges 100 against the urging force of the press members 63, causing the developing rollers 110 to be separated from the photoconductor drums 61. In this manner, as illustrated in FIG. 3, when the separating levers 64 are caused to rotate in a clockwise direction in the drawings, the projections 101 are pushed obliquely upward by pressing members 641 of the separating levers 64, and the developing rollers 110 are separated from the photoconductor drums 61. Each of the separating levers 64 is configured so as to be operated by using the contact/separation cam 200 illustrated in FIG. 4.

Specifically, the contact/separation cam 200 is supported so as to be capable of moving in the front-rear direction in the device body 10, and has a first contact/separation cam surface 201 and three second contact/separation cam surfaces 202 as main portions.

The first contact/separation cam surface 201 is a cam surface for causing a first developing roller 110A for monochrome, of the plurality of developing rollers 110 (see FIG. 1), to contact with and separate from a first photoconductor drum 61A corresponding to the first developing roller 110A, and is formed so as to incline in respect to a front-rear direction. Furthermore, a front side of the first contact/separation cam surface 201 is formed such that a first retaining surface 203 for retaining the first developing roller 110A in the separate position is formed so as to be parallel in a front-rear direction.

Figure 5A:
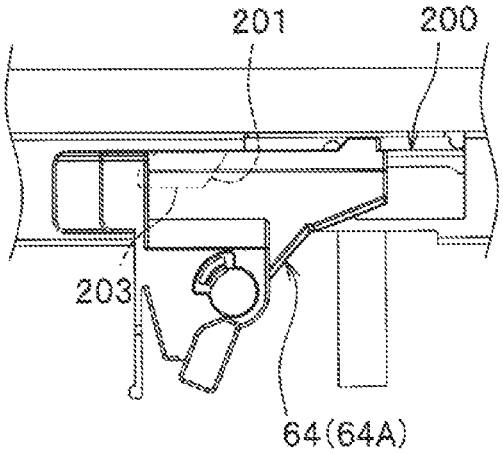
FIGS. 5A to 5C are diagrams illustrating a relationship between a first contact/separation cam surface and a first separating lever, where
Figure 5B:
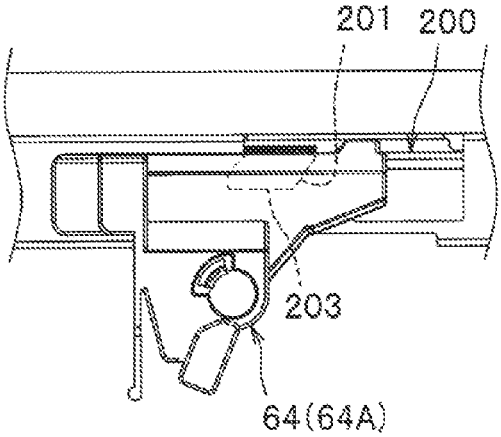
Figure 5C:
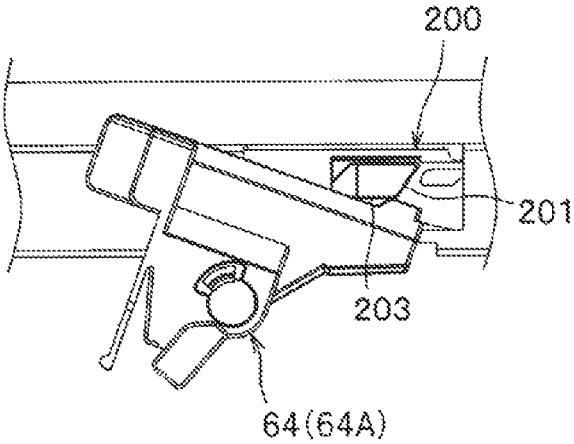

In this manner, when the contact/separation cam 200 is moved backward, as illustrated in FIGS. 5A to 5C, the first contact/separation cam surface 201 comes into contact with a first separating lever 64A corresponding to the first developing roller 110A, pressing down the first separating lever 64A in the clockwise direction in the drawings. When the first separating lever 64A is pressed down to the first retaining surface 203, the first separating lever 64A (the urging force of the press member 63) is received by the first retaining surface 203, and thereby the first developing roller 110A is retained in the separate position.

Furthermore, conversely, when the contact/separation cam 200 is moved forward from the position illustrated in FIG. 5C, the first separating lever 64A that is being urged by the press member 63 moves so as to slide over the first retaining surface 203 and the first contact/separation cam surface 201, thereby returning to the position illustrated in FIG. 5A, causing the first developing roller 110A to move to the contact position.

Figure 4:
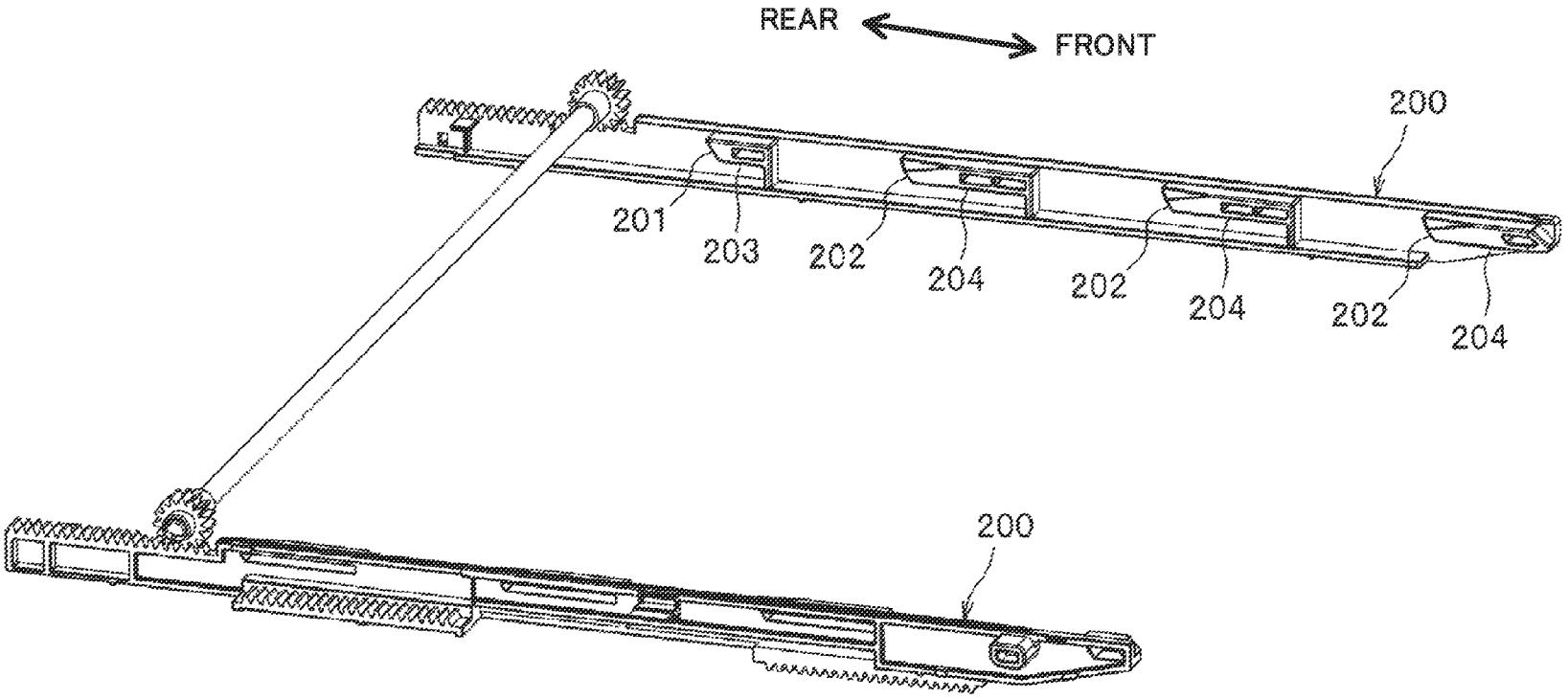
FIG. 4 is a perspective view illustrating a contact/separation cam.

As illustrated in FIG. 4, each of the second contact/separation cam surfaces 202 is a cam surface for causing a second developing roller 110B (see FIG. 1) to contact with and separate from a second photoconductor drum 61B corresponding to the second developing roller 110B, and is formed so as to incline in respect to a front-rear direction. Furthermore, a front side of the second contact/separation cam surfaces 202 is formed such that a second retaining surface 204 for retaining the second developing roller 110B in the separate position is formed so as to be parallel in a front-rear direction.

Figure 6A:
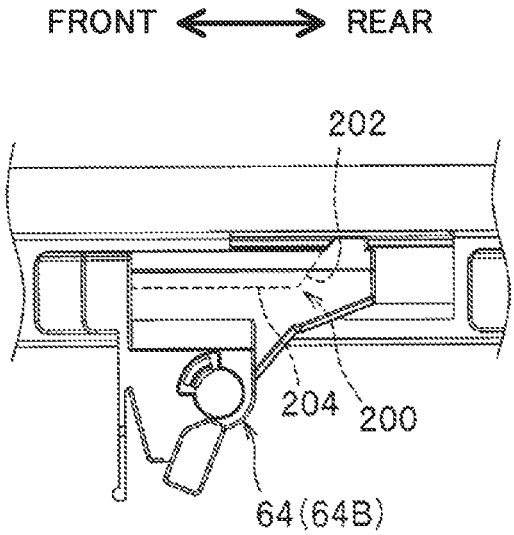
FIGS. 6A to 6C are diagrams illustrating a relationship between a second contact/separation cam surface and a second separating lever, where
Figure 6B:
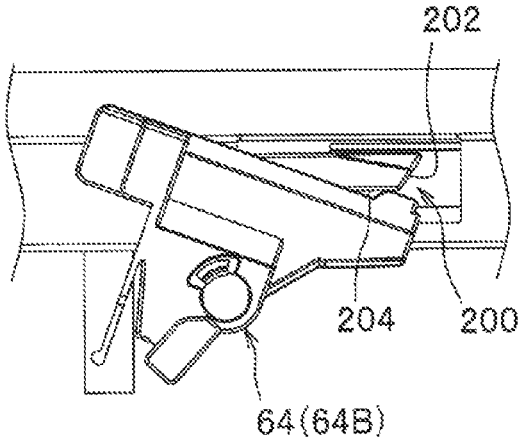
Figure 6C:
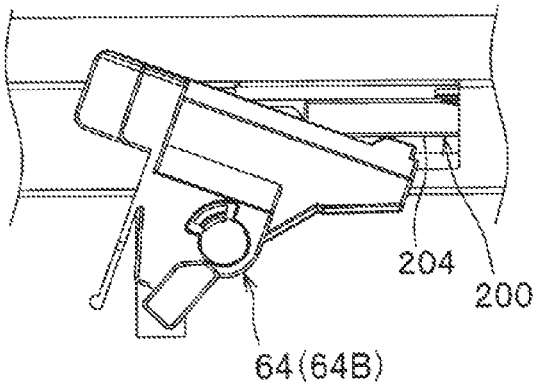

In this manner, the second contact/separation cam surface 202 and the second retaining surface 204 are configured so as to exert the same effect as the first contact/separation cam surface 201 and the first retaining surface 203. That is to say, when the contact/separation cam 200 is moved backward, as illustrated in FIGS. 6A to 6C, the second separating lever 64B corresponding to the second developing roller 110B pivots in the clockwise direction in the drawings and the second developing roller 110B is retained in the separate position. Furthermore, when the contact/separation cam 200 is moved forward, the second separating lever 64B pivots in a counter-clockwise direction in the drawings and the second developing roller 110B moves to the contact position.

Furthermore, as illustrated in FIG. 4, the distance between adjoining pairs of the second contact/separation cam surfaces 202 are respectively the same distance, whereas the distance between the adjoining first contact/separation cam surface 201 and second contact/separation cam surface 202 is set to a distance that differs from that of the pairs of the contact/separation cam surfaces 202. In other words, since the plurality of separating levers 64 are disposed at the same pitch, the positions of the second contact/separation cam surfaces 202 in respect to the second separating levers 64B differ from the position of the first contact/separation cam surface 201 in respect to the first separating lever 64A.

Described in yet another way, since each separating lever 64 is disposed in the same position in respect to each developing roller 110, the positions of the second contact/separation cam surfaces 202 for the second developing rollers 110B differ from the position of the first contact/separation cam surface 201 for the first developing roller 110A. Accordingly, as illustrated in FIGS. 5A to 5C and 6A to 6C, the timing of the movement of the first separating lever 64A can differ from that of the second separating levers 64B, making it possible to switch the mode of a contact/separation state of the developing roller 110 to three modes.

Specifically, it is possible to switch the contact state of the developing rollers 110 between a color mode in which, as illustrated in FIG. 5A and FIG. 6A, all of the developing rollers 110 are in contact with corresponding photoconductor drums 61, a monochrome mode in which, as illustrated in FIG. 5B and FIG. 6B, only the first developing roller 110A for monochrome is in contact, and a complete separation mode in which, as illustrated in FIG. 5C and FIG. 6C, all of the developing rollers 110 are separated from corresponding photoconductor drums 61.

As illustrated in FIG. 1, the switching cam 300 is a translation cam that is supported so as to be movable in the front-rear direction in the device body 10, and is connected to the motor 400 via a pendulum gear mechanism 420 (an example of a positive rotational transmission mechanism and a second transmission mechanism). The switching cam 300 is configured so as to allow or inhibit transmission of the driving force to the plurality of developing rollers 110 by moving in a front-rear direction.

Figure 7:
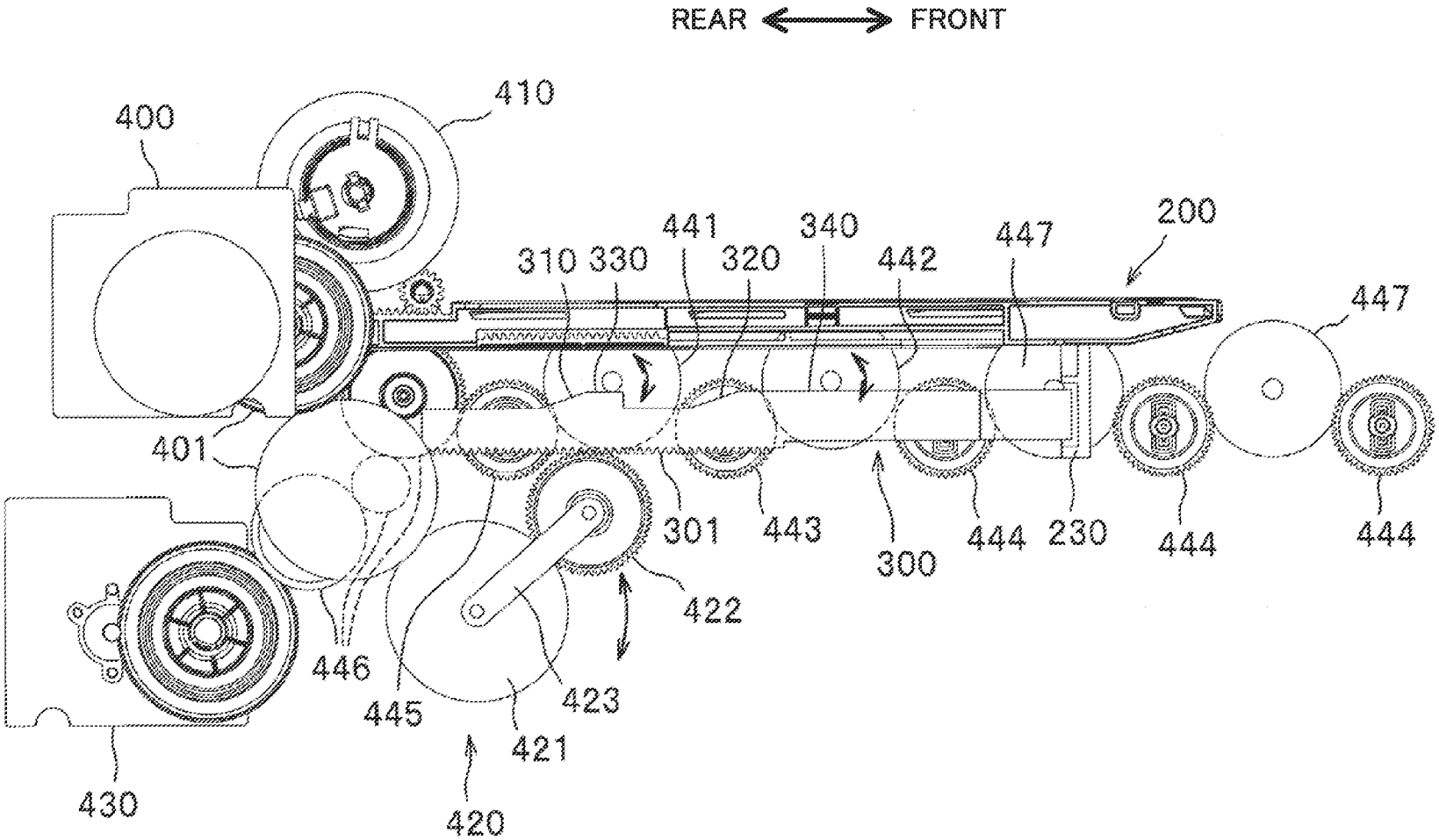
FIG. 7 is a diagram illustrating a relationship between a motor, a contact/separation cam and a switching cam in a complete separation mode.
Figure 8:
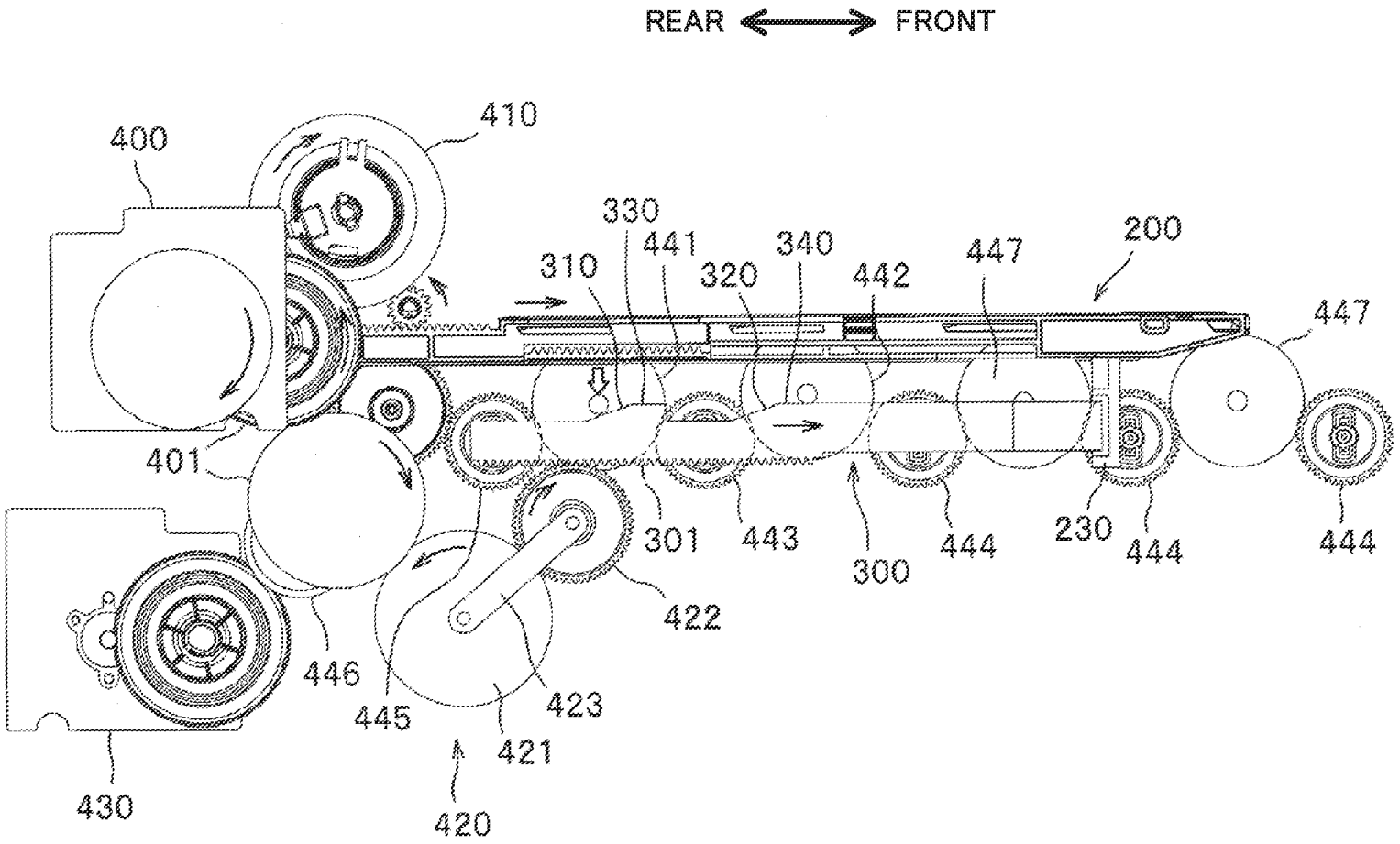
FIG. 8 is a diagram illustrating a relationship between a motor, a contact/separation cam and a switching cam when transferred from a complete separation mode to a monochrome mode.
Figure 9:
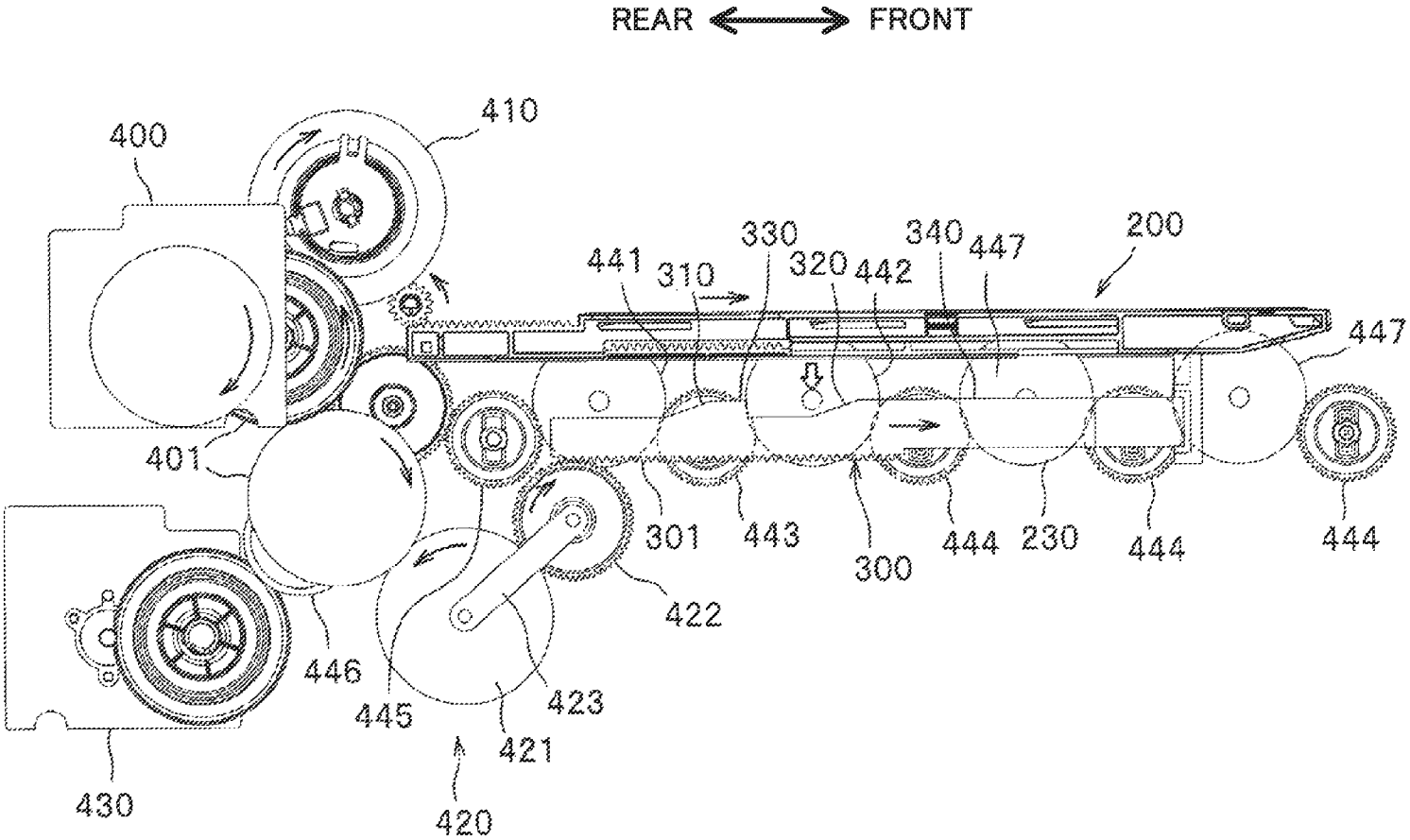
FIG. 9 is a diagram illustrating a relationship between a motor, a contact/separation cam and a switching cam when transferred from a monochrome mode to a color mode.

Specifically, as illustrated in FIG. 7 to FIG. 9, the switching cam 300 is configured so as to switch positions of a first gear 441 (an example of a first transmission member) and a second gear 442 (an example of a second transmission member), by moving in a front-rear direction, between a transmission position (the position illustrated in FIGS. 8 and 9) and a breakoff position (the position illustrated in FIG. 7). Here, transmission position refers to a position in which a driving force of a motor 430 for driving the developing rollers 110 is transmitted to the developing rollers 110, and breakoff position refers to a position in which the driving force is broken off from the motor 430 to the developing rollers 110.

Specifically, the mechanism that transmits driving force from the motor 430 to each of the developing rollers 110 includes the first gear 441 and the second gear 442 mentioned above, a first driving gear 443 corresponding to the first developing roller 110A for monochrome, a plurality of second driving gears 444 corresponding to the second developing rollers 110B for color, a plurality of gears 445 and 446 for connecting the first gear 441 and the motor 430, and gears 447 for connecting the second driving gears 444.

The first gear 441 is configured so as to be capable of revolving around the gear 445 disposed on the upstream side in a transmission direction of the driving force, and is capable of connecting to and separating from the first driving gear 443. The second gear 442 is configured so as to be capable of revolving around the first driving gear 443, and is capable of connecting to and separating from the second driving gear 444.

The switching cam 300 includes a first switching cam surface 310 that switches a position of the first gear 441, and a second switching cam surface 320 that switches a position of the second gear 442, and includes a first support surface 330 that retains the first gear 441 in a breakoff position, and a second support surface 340 that retains the second gear 442 in the breakoff position. The position of the first switching cam surface 310 for the first gear 441 (e.g. the position of a front end of the first switching cam surface 310 in respect to a center of the first gear 441) is differently set from the position of the second switching cam surface 320 for the second gear 442.

Accordingly, as illustrated in FIG. 7 to FIG. 9, the timing at which the first gear 441 starts moving can be different from the timing at which the second gear 442 starts moving, making it possible to switch the mode of a drive state of the developing rollers 110 between three modes. Specifically, it is possible to switch the driving state of the developing rollers 110 between a non-transmission mode in which, as illustrated in FIG. 7, driving force is not transmitted to all of the developing rollers 110, a monochrome mode in which, as illustrated in FIG. 8, driving force is transmitted to only the first developing roller 110A for monochrome (the first driving gear 443), and a color mode in which, as illustrated in FIG. 9, driving force is transmitted to all of the developing rollers 110 (the first driving gear 443 and all of the second driving gears 444).

The pendulum gear mechanism 420 is a mechanism that transmits only driving force during positive rotation of the motor 400 to the switching cam 300, mainly including a sun gear 421, a planetary gear 422, and a connecting member 423. The sun gear 421 is connected to the motor 400 via a plurality of gears 401.

The rotational axis of the planetary gear 422 is connected to the rotational axis of the sun gear 421 using the connecting member 423, and moves (revolve) around the sun gear 421. As illustrated in FIGS. 8 and 9, during positive rotation of the motor 400 (when revolving in the clockwise direction in the drawings), the planetary gear 422 is urged against the switching cam 300 by the connecting member 423 that rocks in the counter-clockwise direction in the drawings, thereby engaging (connecting) with gear teeth 301 of the switching cam 300. Furthermore, as illustrated in FIG. 10, during reverse rotation of the motor 400, the planetary gear 422 is separated (the connection is released) from the gear teeth 301 of the switching cam 300 by the connecting member 423.

In this manner, as illustrated in FIG. 7 to FIG. 9, during positive rotation of the motor 400, it is possible to move the switching cam 300 forward using the driving force of the motor 400, and, during reverse rotation of the motor 400, this enables the connection between the motor 400 and the switching cam 300 to be cut.

Furthermore, a front portion of the contact/separation cam 200 that is disposed above the switching cam 300 is provided with a locking portion extending downward and capable of locking onto a front end of the switching cam 300. The locking portion 230 (an example of a third transmission mechanism) is configured so as to lock onto the front end of the switching cam 300 in the front-rear direction during reverse rotation of the motor 400, thereby causing the contact/separation cam 200 and the switching cam 300 to move backward. In other words, with such a configuration, the driving force during reverse rotation of the motor 400 is transmitted to the switching cam 300 via the contact/separation cam 200.

Figure 10:
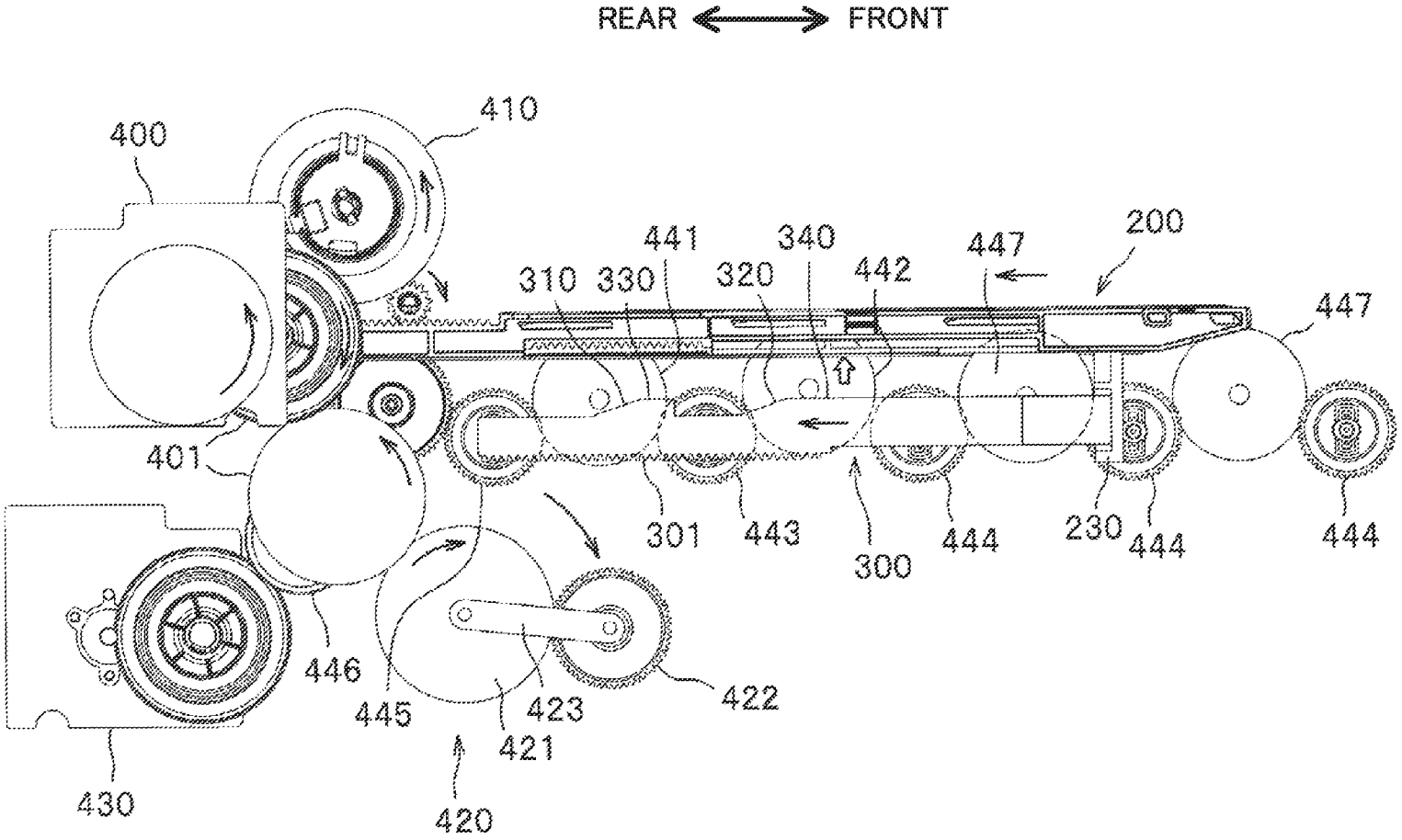
FIG. 10 is a diagram illustrating a relationship between a motor, a contact/separation cam and a switching cam when transferred from a color mode to a monochrome mode.
Figure 11:
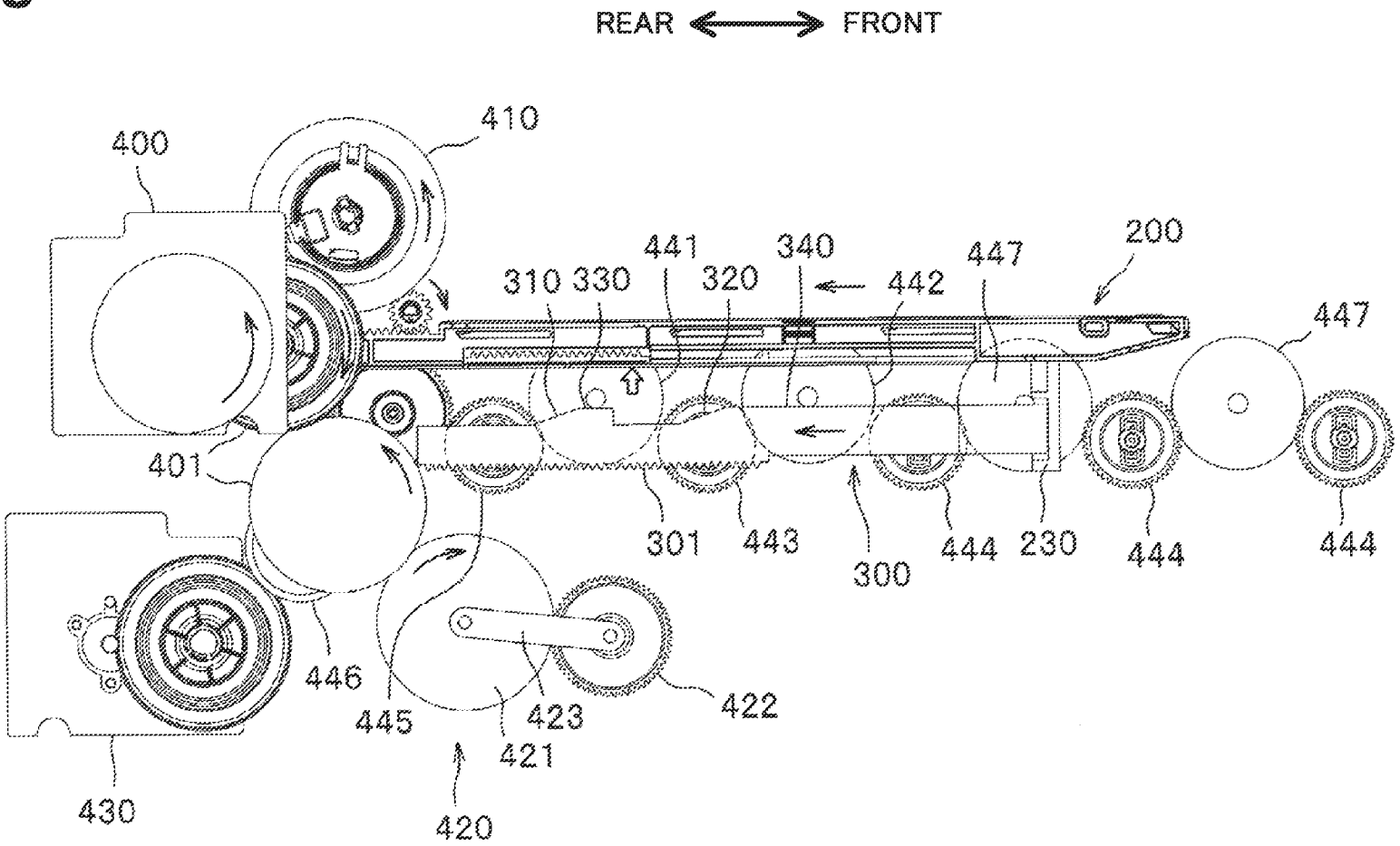
FIG. 11 is a diagram illustrating a relationship between a motor, a contact/separation cam and a switching cam when transferred from a monochrome mode to a complete separation mode.

Accordingly, as illustrated in FIGS. 10 and 11, during reverse rotation of the motor 400, the contact/separation cam 200 and the switching cam 300 move together to return to the starting position, and therefore the positional relationship between the contact/separation cam 200 and the switching cam 300 in the starting position can be kept almost constant.

The contact/separation cam 200 and the switching cam 300 are controlled by a control device 450 illustrated in FIG. 1. The control device 450 includes a CPU, a RAM, a ROM and input-output circuitry, and implements control by performing each arithmetic process based on programs and data, etc., stored in the ROM.

Specifically, the control device 450 controls the electromagnetic clutch 410 so as to cause the first gear 441 to move from the breakoff position to the transmission position prior to the first developing roller 110A moving from the separate position to the contact position, and the second gear 442 to move from the breakoff position to the transmission position prior to the second developing rollers 110B moving from the separate position to the contact position. Accordingly, the stopped developing rollers 110 are brought into contact with the rotating photoconductor drums 61, thereby making it possible to suppress wearing down of the developing rollers 110.

Furthermore, the device body 10 is provided with a sensor 460 that detects the starting position of the contact/separation cam 200 (the position in FIG. 7), and the control device 450 determines whether or not the contact/separation cam 200 has reached the starting position based on a signal from the sensor 460, and, in a case where the starting position has not been reached, the control device 450 controls the motor 400 and controls the contact/separation cam 200 to return to the starting position. Accordingly, when the control device 450 has attempted to return the contact/separation cam 200 to the starting position by using the reverse rotation of the motor 400, as illustrated in FIG. 11, in a case where the contact/separation cam 200 is offset from the starting position, the amount of offset is calculated based on the signal from the sensor 460. Since positive rotation or reverse rotation of the motor 400 are applied to finely adjust the position of the contact/separation cam 200 based on the amount of offset, it is possible to return the contact/separation cam 200 reliably to the starting position.

According to the above-described configuration, effects such as the following can be obtained according to the present embodiment.

The contact/separation cam 200 and the switching cam 300 can be driven with a single motor 400 by using reversible rotation of the motor 400 and the electromagnetic clutch 410, and therefore the cost can be reduced.

Since the first gear 441 (or the second gear 442) moves from the breakoff position to the transmission position prior to the developing rollers 110 moving from the separate position to the contact position, the stopped developing rollers 110 are brought into contact with the rotating photoconductor drums 61, thereby suppressing wearing down of the developing rollers 110.

Since the positions of the second contact/separation cam surfaces 202 in respect to the second developing rollers 110B differs from the position of the first contact/separation cam surface 201 in respect to the first developing roller 110A, and the position of the second switching cam surface 320 in respect to the second gear 442 differs from the position of the first switching cam surface 310 in respect to the first gear 441, the contact/separation state between the developing rollers 110 and the photoconductor drums 61, and the driving state of the developing rollers 110, can be switched between three modes.

Since the driving force during reverse rotation of the motor 400 is transmitted to the switching cam 300 via the contact/separation cam 200, the positional relationship between the contact/separation cam 200 and the switching cam 300 in the starting position can be kept almost constant.

During reverse rotation of the motor 400, since the connection between the switching cam 300 and the motor 400 can be completely cut by using the pendulum gear mechanism 420 (and since the planetary gear 422 is separated from the switching cam 300), the load when returning the switching cam 300 to the starting position can be reduced compared to a structure in which the driving force during reverse rotation cuts by using a one-way clutch, for example.

Since the electromagnetic clutch 410 is provided on the contact/separation cam 200 side, a structure in which the contact/separation cam 200 is moved after the switching cam 300 has been moved first (a structure in which elements such as the first gear 441 are moved from the breakoff position to the transmission position prior to the developing rollers 110 moving from the separate position to the contact position as previously mentioned) can easily be made.

The present invention is not limited to the above-described embodiment and various changes may be made therein as illustrated in the following examples. In the following description, the same reference numerals will be used to designate substantially the same components as those in the above-described embodiment, and the description thereof will be omitted.

According to the embodiment, the motor 400 is connected to the contact/separation cam 200 and the switching cam 300, but the present invention is not limited to this and the motor 400 and a fixing device 80 may be connected such that the driving force of the motor 400 is transmitted to the fixing device 80. In this case, since a dedicated motor for the fixing device 80 is not required, the cost can be further reduced.

According to the embodiment, translation cams are adopted for the contact/separation cam 200 and the switching cam 300, but the present invention is not limited to this and these may be elements such as disk cams where distances from the center to the circumference differ, for example.

According to the embodiment, aside from the motor 400 for driving elements such as the contact/separation cam 200, the motor 430 for driving the developing rollers 110 is provided, but the present invention is not limited to this and may be configured such that the developing rollers 110 are driven by the driving force of the motor 400.

According to the embodiment, the pendulum gear mechanism 420 is exemplified as the positive rotational transmission mechanism, but the present invention is not limited to this and may be an element such as a one-way clutch, for example.

In the above-described embodiment, the present invention is applied to a color printer 1. However, the present invention is not limited to this. The present invention may be applied to any other image forming apparatus, for example, a monochrome printer, a copying machine or a multifunction device.

According to the embodiment, the switching cam 300 is connected to the motor 400 via the pendulum gear mechanism 420, and the contact/separation cam 200 is connected to the motor 400 via the magnetic clutch 410, but the switching cam 300 may be connected to the motor 400 via the magnetic clutch, and the contact/separation cam 200 connected to the motor 400 via the pendulum gear mechanism 420.

What is claimed is:

1. An image forming device comprising:

a motor capable of positive rotation and reverse rotation;

a photoconductor drum on which an electrostatic latent image is to be formed;

a developing roller configured to contact the photoconductor drum and supply developer to the electrostatic latent image on the photoconductor drum;

a contact/separation cam configured to move the developing roller between a contact position contacting the photoconductor drum and a separate position separate from the photoconductor drum, and configured to move in a first direction and a second direction opposite to the first direction; and a switching cam configured to switch a position of a transmission member movable between a transmission position in which a driving force of the motor is transmitted to the developing roller and a breakoff position in which the driving force of the motor is broken off of the developing roller, and configured to move in a third direction and a fourth direction opposite to the third direction, wherein an electromagnetic clutch is disposed between a first cam and the motor, the first cam being one of the contact/separation cam and the switching cam, wherein a second cam is connected to the motor without the electromagnetic clutch, the second cam being a different one of the contact/separation cam and the switching cam than the first cam, wherein the contact/separation cam and the switching cam are to be driven by using the positive rotation and the reverse rotation of the motor and the electromagnetic clutch, and wherein the motor, the contact/separation cam and the switching cam are arranged such that during the positive rotation of the motor, the contact/separation cam moves in the first direction and the switching cam moves in the third direction, and during the reverse rotation of the motor, the contact/separation cam moves in the second direction and the switching cam moves in the fourth direction.

2. The image forming device according to claim 1, further comprising a control device configured to control the electromagnetic clutch such that the transmission member moves from the breakoff position to the transmission position before the developing roller moves from the separate position to the contact position.

3. The image forming device according to claim 2, wherein:

the image forming device comprises a plurality of developing rollers and a plurality of photoconductor drums;

the contact/separation cam includes a first contact/separation cam surface and a second contact/separation cam surface, the first contact/separation cam surface being configured to allow a first developing roller among the plurality of developing rollers to contact and separate from a first photoconductor drum corresponding to the first developing roller, the second contact/separation cam surface being configured to allow a second developing roller that differs from the first developing roller to contact and separate from a second photoconductor drum corresponding to the second developing roller;

the switching cam comprises a first switching cam surface and a second switching cam surface, the first switching cam surface being configured to switch a position of a first transmission member corresponding to the first developing roller, the second switching cam surface being configured to switch a position of a second transmission member corresponding to the second developing roller; and the position of the first contact/separation cam surface for the first developing roller differs from the position of the second contact/separation cam surface for the second developing roller, and the position of the first switching cam surface for the first transmission member differs from the position of the second switching cam surface for the second transmission member.

4. The image forming device according to claim 3, wherein:

the plurality of photoconductor drums is configured to form a developer image on a recording sheet;

the contact/separation cam and the switching cam are translation cams movable in an array direction of the plurality of developing rollers, wherein the array direction of the plurality of developing rollers is parallel to a direction in which the recording sheet is being fed when the plurality of photoconductor drums is forming the developer image on the recording sheet;

a positive rotational transmission mechanism configured to transmit only driving force during positive rotation of the motor to the second cam is disposed between the second cam and the motor; and the driving force of the motor during reverse rotation is transmitted to the second cam via the first cam by engaging the first cam with the second cam in the array direction during reverse rotation of the motor.

5. The image forming device according to claim 4, wherein:

the positive rotational transmission mechanism is a pendulum gear mechanism comprising a sun gear, a planetary gear configured to revolve around the sun gear, and a connecting member configured to connect an axis of the planetary gear with an axis of the sun gear; and the positive rotational transmission mechanism is configured to be connected to the second cam during positive rotation of the motor, and to be disconnected from the second cam during reverse rotation of the motor.

6. The image forming device according to claim 1, wherein the first cam is the contact/separation cam.

7. The image forming device according to claim 1, further comprising a fixing device configured to fix a developer image formed on a recording sheet by heat, wherein the fixing device is connected to the motor such that the driving force of the motor is transmitted to the fixing device.

8. An image forming device comprising:

a motor capable of positive rotation and reverse rotation;

a process unit comprising a first member and a second member;

a transmission member;

a first cam configured to move the second member between a contact position in which the second member contacts with the first member and a separate position in which the second member is separate from the first member, and configured to move in a first direction and a second direction opposite to the first direction;

a first transmission mechanism comprising an electromagnetic clutch and which is configured such that a driving force from the motor is switched to be transmitted and not to be transmitted to the first cam regardless of whether the positive rotation or the reverse rotation of the motor;

a second cam configured to move the transmission member between a transmission position in which a driving force from the motor is transmitted to the second member and a non-transmission position in which the driving force is not transmitted to the second member, and configured to move in a third direction and a fourth direction opposite to the third direction; and a second transmission mechanism comprising a positive rotational transmission mechanism and configured to transmit the driving force from the motor to the second cam during the positive rotation of the motor and not to transmit the driving force from the motor to the second cam during the reverse rotation, wherein the motor, the first cam and the second cam are arranged such that during the positive rotation of the motor, the first cam moves in the first direction and the second cam moves in the third direction, and during the reverse rotation of the motor, the first cam moves in the second direction and the second cam moves in the fourth direction.

9. The image forming device according to claim 8, wherein the first member is a photoconductor drum, and the second member is a developing roller.

10. The image forming device according to claim 8, wherein the positive rotational transmission mechanism comprises a pendulum gear mechanism configured to transmit the driving force from the motor during the positive rotation of the motor and not to transmit the driving force from the motor during reverse rotation of the motor.

11. The image forming device according to claim 8, wherein the positive rotational transmission mechanism comprises a one-way clutch.

12. The image forming device according to claim 8, wherein:

the first cam comprises a third transmission mechanism; and during the reverse rotation, by engaging the third transmission mechanism with the second cam, the second cam moves as the first cam moves.

13. The image forming device according to claim 8, wherein:

the image forming device comprises a plurality of developing rollers and a plurality of photoconductor drums configured to form a developer image on a recording sheet; and the first cam and the second cam are translation cams movable in an array direction of the plurality of developing rollers, wherein the array direction of the plurality of developing rollers is parallel to a direction in which the recording sheet is being fed when the plurality of photoconductor drums is forming the developer image on the recording sheet.

14. An image forming device comprising:

a motor capable of positive rotation and reverse rotation;

a process unit comprising a first member and a second member;

a transmission member;

a first cam configured to move the second member between a contact position in which the second member contacts with the first member and a separate position in which the second member is separate from the first member, and configured to move in a first direction and a second direction opposite to the first direction;

a first transmission mechanism comprising a positive rotational transmission mechanism and configured to transmit a driving force from the motor to the first cam during the positive rotation of the motor and not to transmit the driving force from the motor to the first cam during the reverse rotation;

a second cam configured to move the transmission member between a transmission position in which the driving force from the motor is transmitted to the second member and a non-transmission position in which the driving force is not transmitted to the second member, and configured to move in a third direction and a fourth direction opposite to the third direction; and a second transmission mechanism comprising an electromagnetic clutch and which is configured such that the driving force from the motor is switched to be transmitted and not to be transmitted to the second cam regardless of whether the positive rotation or the reverse rotation of the motor, wherein the motor, the first cam and the second cam are arranged such that during the positive rotation of the motor, the first cam moves in the first direction and the second cam moves in the third direction, and during the reverse rotation of the motor, the first cam moves in the second direction and the second cam moves in the fourth direction.

* * * * *